US005605181A

United States Patent [19]

Vuong

[11] Patent Number: 5,605,181

[45] Date of Patent: Feb. 25, 1997

[54] PORTABLE WIRE TWISTING TOOL

[75] Inventor: Cuong T. Vuong, Fountain Valley, Calif.

[73] Assignee: Northrop Grumman Corporation, Los Angeles, Calif.

[21] Appl. No.: 387,981

[22] Filed: Feb. 13, 1995

[51] Int. Cl.[6] ..... B21F 7/00

[52] U.S. Cl. ..... 140/119; 140/120

[58] Field of Search ..... 140/118, 119, 140/120, 149

[56] References Cited

U.S. PATENT DOCUMENTS

| | | | |
|---|---|---|---|
| 514,692 | 2/1894 | Alverson . | |
| 1,293,880 | 2/1919 | Neville | 140/119 |
| 1,438,650 | 12/1922 | Johnson . | |
| 1,511,237 | 10/1924 | Shreckengast . | |
| 1,714,387 | 5/1929 | Martinet . | |
| 1,736,781 | 11/1929 | Drews . | |
| 1,822,833 | 9/1931 | Wilking . | |
| 1,929,678 | 10/1933 | Dodge et al. | 140/119 |
| 2,397,739 | 4/1946 | Hutsell | 140/119 |
| 3,590,391 | 7/1971 | Winegar | 140/119 |
| 4,527,599 | 7/1985 | Clark | 140/119 |

*Primary Examiner*—Lowell A. Larson
*Attorney, Agent, or Firm*—Terry J. Anderson; Karl J. Hoch, Jr.

[57] ABSTRACT

Handheld wire twisting apparatus can be readily applied to a working section of an elongated electrical harness to be twisted, operated to impart twist to the desired extent, then removed after the twist has been secured in the harness. It includes a housing with an integral handle. An internal cylindrical bearing surface defines a transverse axis and includes an inlet into a bearing cavity which is a hiatus in the bearing surface. A c-shaped cylindrical wire twisting head is journaled on the cylindrical bearing surface for rotation about the transverse axis and defines a transverse passageway for reception of a wire bundle to be twisted. The wire twisting head has a peripheral gap for reception of the wire bundle into the transverse passageway when the peripheral gap is coextensive with the inlet in the housing. A gear train is rotatably mounted between opposed plate members comprising the housing for rotating the head, selectively, in first and second directions about the transverse axis and a ratchet mechanism selectively preventing rotation of the head in the first and second directions. The wire twisting head includes a c-shaped cylindrical drive wheel, a c-shaped cylindrical socket member having a peripheral opening and adapted for releasable attachment to the drive wheel, and a diametrically extending wire engagement member fixed to the socket member and projecting toward the peripheral opening. Mutually engageable key means on the socket member and on the drive wheel releasably attaches the socket member to the drive wheel.

7 Claims, 4 Drawing Sheets

PORTABLE WIRE TWISTING TOOL

BACKGROUND OF THE INVENTION

1. Field of the Invention

The present invention relates generally to wire twisting apparatus and, particularly, to hand held apparatus which can be applied to a working section of an elongated electric harness, operated to twist the harness to the desired extent, then be removed after the twist has been secured in the harness, all with minimal effort.

2. Description of the Prior Art

Typical of known apparatus for imparting twist to a plurality of wire strands generally about their longitudinal axes is the disclosure in U.S. Pat. No. 4,527,599 to Clark. In the instance of the patented construction, the wire twister is said to find particular usefulness for tensioning multi-strand wires to secure a load to a truck or other vehicle.

Also known is the construction related in U.S. Pat. No. 3,590,391 which discloses a three-handled hand twister that opens and closes to engage and disengage the wire. The manipulation of the twisting devise therein disclosed is cumbersome and is further handicapped because the wire tension obtainable is dependent upon the strength of the user.

There are numerous examples of wire twisting devices for effectively tightening wire used in connection with concrete molding forms. Typical of these are the U.S. patents, U.S. Pat. No. 1,822,833 to Wilkins, U.S. Pat. No. 1,736,781 to Drews, U.S. Pat. No. 1,714,387 to Martinet, U.S. Pat. No. 1,511,237 to Shreckengast, and U.S. Pat. No. 1,438,650 to Johnson. Once again, the tension obtainable in each of these instances is dependent upon the strength of the user.

To maintain flexibility in an electrical harness it is customarily twisted along its length. The twisting process requires twisting the harness in a clockwise direction for a certain length, then twisting it in the counterclockwise direction for another certain length. This process is then repeated throughout the entire length of the electrical harness.

Presently, in customary fashion, assemblers manually twist the wires of an electrical harness progressively along its length in one direction at a time, beginning at a free end. This long and tedious process can be shortened drastically by inserting the tool at a transition area, that is, intermediate the ends of the harness being operated upon. Once the head of a twisting tool begins turning, it will operate to twist the harness in a clockwise direction on one side of the tool and in a counterclockwise direction on the other side.

It was in light of the state of the technology as just discussed that the present invention was conceived and has now been reduced to practice.

SUMMARY OF THE INVENTION

According to the invention, handheld wire twisting apparatus is disclosed which can be readily applied to a working section of an elongated electrical harness to be twisted, operated to impart twist to the desired extent, then removed after the twist has been secured in the harness. It includes a housing with an integral handle. An internal cylindrical bearing surface defines a transverse axis and includes an inlet into a bearing cavity which is a hiatus in the bearing surface. A c-shaped cylindrical wire twisting head is journaled on the cylindrical bearing surface for rotation about the transverse axis and defines a transverse passageway for reception of a wire bundle to be twisted. The wire twisting head has a peripheral gap for reception of the wire bundle into the transverse passageway when the peripheral gap is coextensive with the inlet in the housing. A gear train is rotatably mounted between opposed plate members comprising the housing for rotating the head, selectively, in first and second directions about the transverse axis and a ratchet mechanism selectively preventing rotation of the head in the first and second directions. The wire twisting head includes a c-shaped cylindrical drive wheel, a c-shaped cylindrical socket member having a peripheral opening and adapted for releasable attachment to the drive wheel, and a diametrically extending wire engagement member fixed to the socket member and projecting toward the peripheral opening. Mutually engageable key devices on the socket member and on the drive wheel releasably attaches the socket member to the drive wheel.

The tool of the invention is designed to snap laterally onto any working section of an electrical harness without requiring the harness to feed longitudinally through the head of the tool. Furthermore, a self-locking mechanism is built into the tool to enable it to withstand any kick back created by the twist memory of the wires.

A primary object of the present invention is to provide a hand-held wire twisting tool which can be engaged to and disengaged from any section of an electrical harness, for example, on mounted on a jig board, without requiring the harness to feed through the head of the twisting tool.

Another object is to provide such a hand-held wire twisting tool which is able to manipulate a clockwise and counterclockwise twist on any length of the electrical harness.

A further object of the invention is to provide such a hand-held wire twisting tool which includes a self locking mechanism to temporarily hold the twist achieved in the electrical harness to enable spot taping to be performed so as to more permanently hold the twist.

Still a further object of the invention is to provide such a hand-held wire twisting tool which is universally designed, being applicable for both right handed and left handed users.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention and, together with the description, serve to explain the principles of the invention in general terms. Like numbers refer to like parts throughout the disclosure.

DETAILED DESCRIPTION OF THE PREFERRED EMBODIMENT

Figure 1:
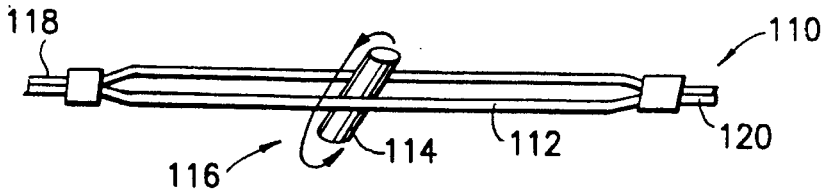
FIG. 1 is a diagrammatic perspective view of an electrical harness in condition to be subjected to a twisting operation.
Figure 2:
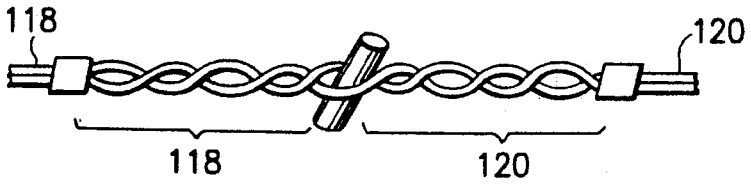
FIG. 2 is a diagrammatic perspective view of the electrical harness of FIG. 1 upon completion of the twisting operation.

Turn now to the drawings and, initially, to FIGS. 1 and 2 which illustrate a conventional twisting operation to be performed by the tool of the present invention. As noted above, to maintain flexibility for an electrical harness 110, a plurality of individual strands 112 are longitudinally twisted. The twisting process requires twisting the harness in a clockwise direction for a certain length, then twisting it in the counterclockwise for another certain length. This process is then repeated throughout the entire length of the harness. Presently, in customary fashion, assemblers manually twist the wires of an electrical harness progressively along its length in one direction at a time, beginning at a free end.

This long and tedious process can be shortened drastically by inserting a wire engagement member 114 at a transition area 116, that is, intermediate secured ends 118, 120 of the harness being operated upon. Once the head of a twisting tool operating the wire engagement member 114 begins turning, it will operate to twist the harness 110 in a clockwise direction on one side 118 of the tool and in a counterclockwise direction on another side 120 of the tool.

Figure 4:
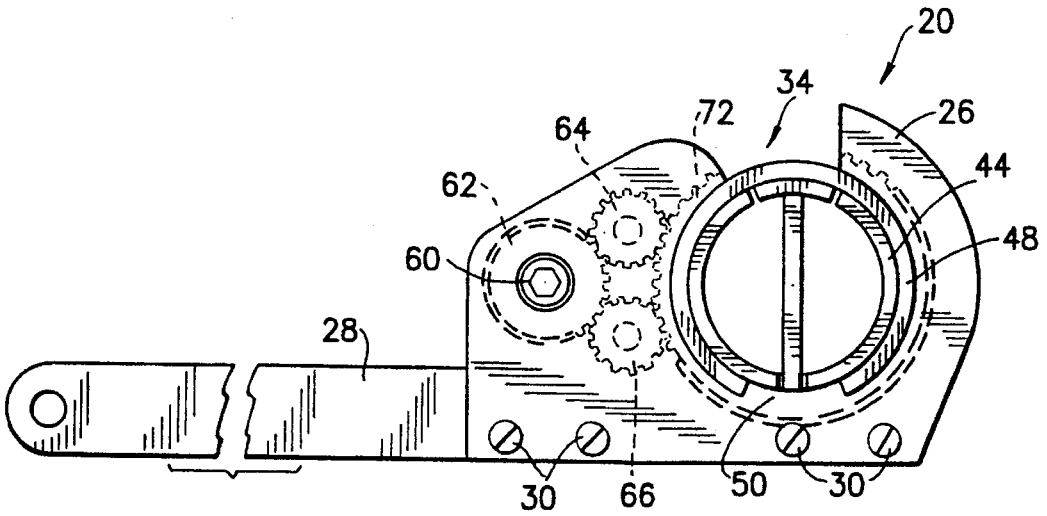
FIG. 4 is a side elevation view of the handheld twisting tool of the present invention.
Figure 3:
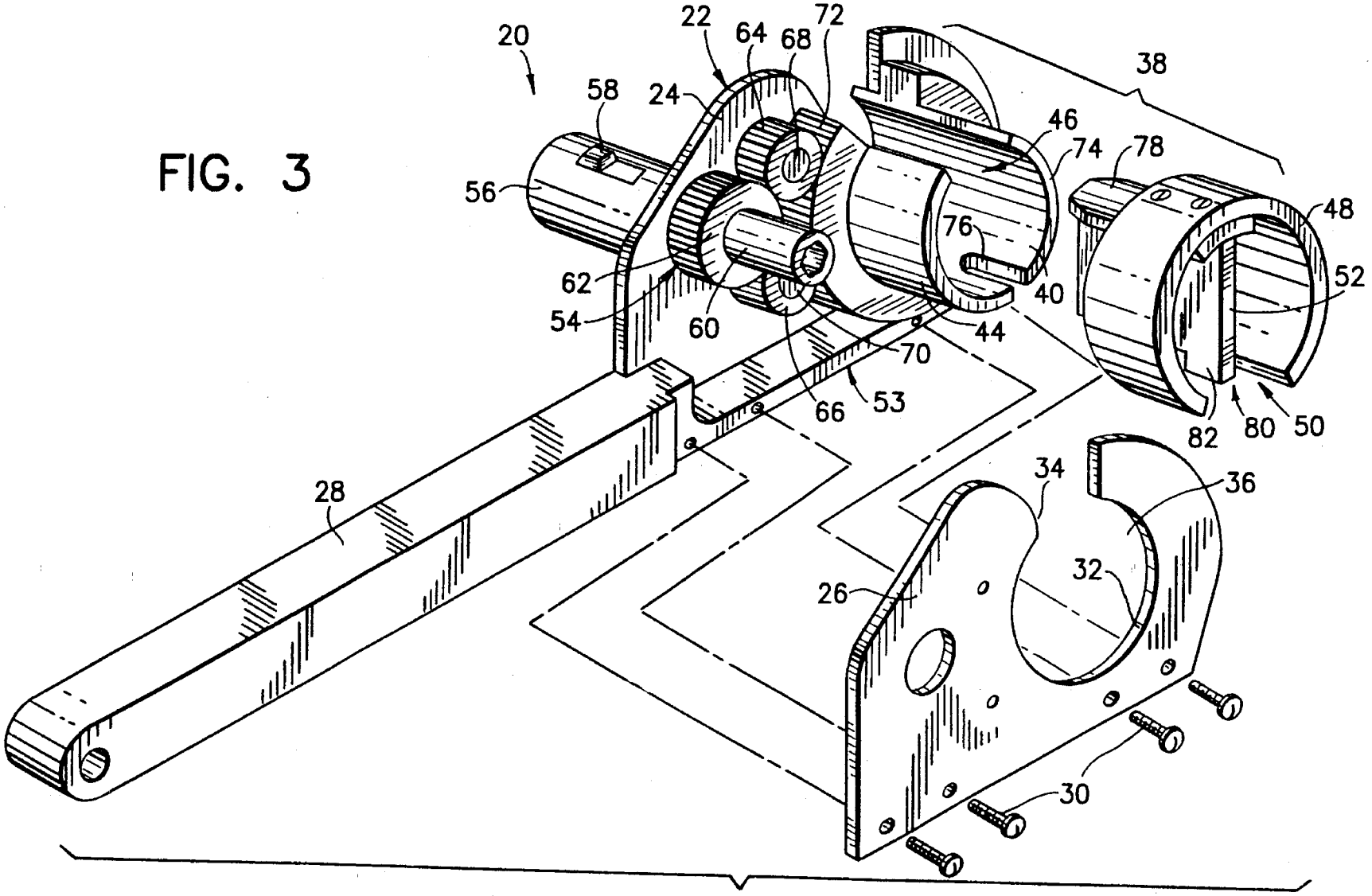
FIG. 3 is an exploded perspective view of a handheld twisting tool embodying the present invention.
Figure 5:
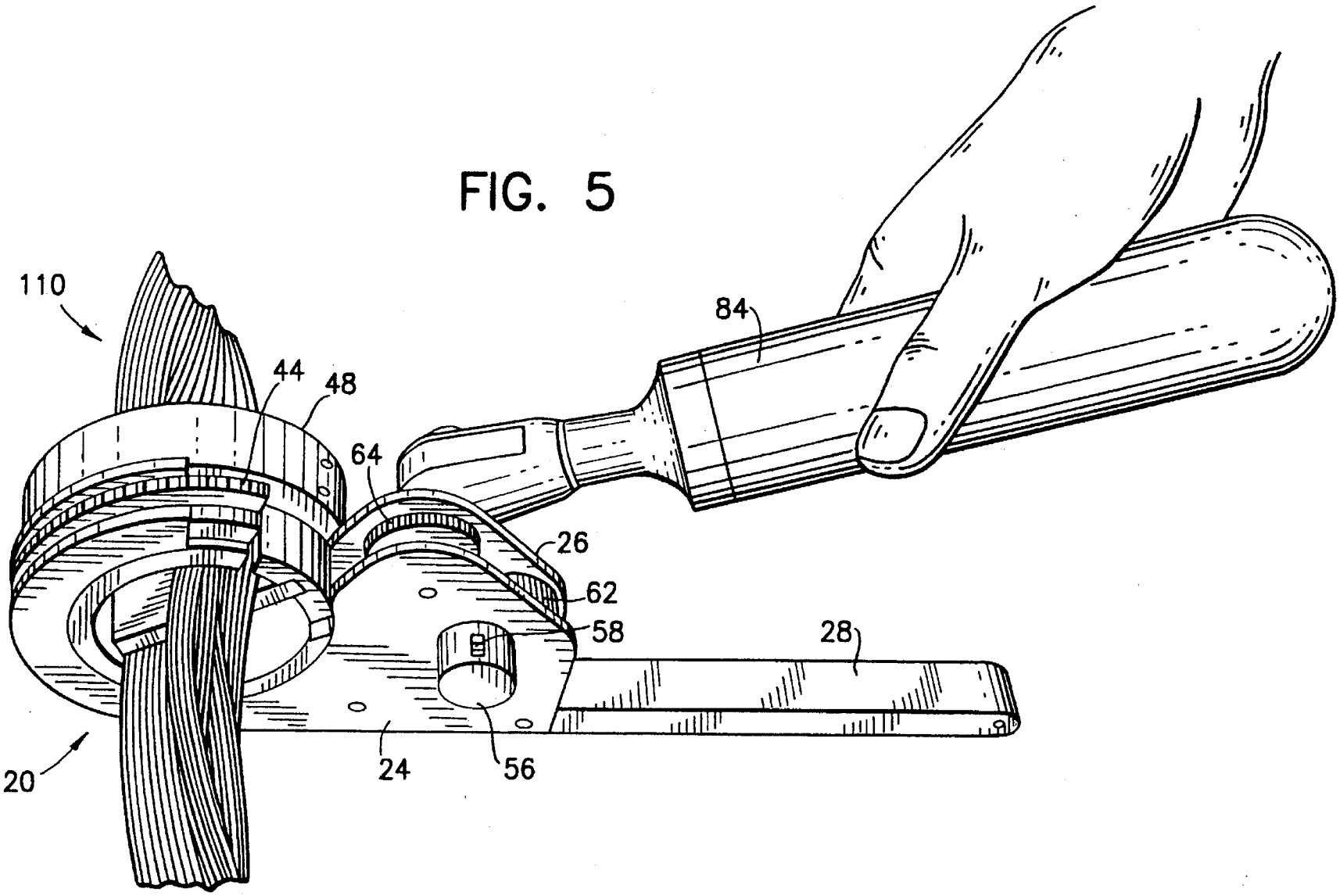
FIG. 5 is a perspective view of the handheld twisting tool of the present invention illustrating it in operation.

FIGS. 3 to 5 illustrate most clearly the overall construction of a hand-held wire twisting tool 20 embodying the present invention. The tool 20 comprises a longitudinally extending housing 22 comprised of spaced opposed plate members 24, 26 which are secured to a proximal end of an elongated handle 28 adapted to be gripped by a user. Screws 30 or other suitable fasteners serve to secure the plate members to the handle. A pair of arcuate, cylindrical, coplanar bearing surfaces 32 are formed on the plate members 24, 26, respectively, and define a transverse axis and an inlet 34 into a bearing cavity 36. The inlet 34 represents a hiatus in the bearing surface 32.

A wire twisting head 38 is journaled on the cylindrical bearing surfaces 32 for rotation about the transverse axis and defining a transverse passageway 34 for reception therethrough of a wire bundle 42 to be twisted. The wire twisting head 38 includes a generally c-shaped drive wheel 44 of cylindrical configuration having a peripheral gap 46 for reception therethrough of the wire bundle into the transverse passageway 40 when the peripheral gap is coextensive with the inlet in the housing. The wire twisting head prevents entry of the wire bundle into the transverse passageway or egress of the wire bundle from the transverse passageway when the peripheral gap is substantially non-coextensive with the inlet in said housing.

The wire twisting head 38 also includes a c-shaped cylindrical socket member 48 having a peripheral opening 50 and adapted for releasable attachment to the drive wheel 44. A diametrically extending wire engagement member 52 is fixed to the socket member and projects toward the peripheral opening.

A drive mechanism 53 for rotating the wire twisting head 38 about the transverse axis to thereby mutually twist in opposite directions the lengths 118, 120 of the electrical wire harness 110 includes a gear train 54 rotatably mounted between the plate members 24, 26. The drive mechanism also includes a suitable ratchet mechanism 56 for preventing rotation of the wire twisting head in an opposite direction about the transverse axis. By operation of a switch 58, the ratchet mechanism selectively prevents rotation of the head 38 about the transverse axis, in one instance preventing rotation in a clockwise direction and in another instance preventing rotation in a counterclockwise direction.

The drive mechanism 53 also includes a drive shaft 60 mounted on the housing 22 for rotation about a transverse drive axis and a drive gear 62 fixed on the drive shaft for rotation therewith. Additionally, the gear train 54 includes first and second pinion gears 64, 66 mounted on the housing 22 by way of idler shafts 68, 70, respectively, operatively engaged with the drive gear 62 for rotation about spaced parallel axes. The wire twisting head 38 also includes integral gear teeth 72 around the periphery thereof operatively engaged with the pinion gears 64, 66 at locations which are dimensionally no less than the width of the peripheral gap in said wire twisting head such that at least one of the pinion gears is in engagement with said peripheral gear teeth at all times.

Figure 6A:
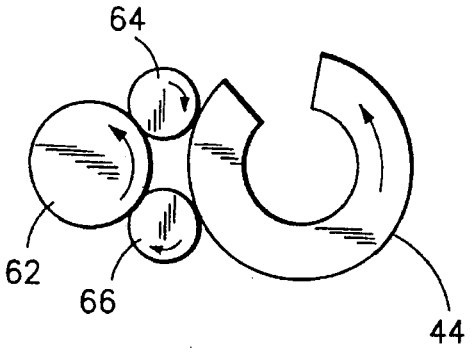
FIGS. 6*a*, 6*b*, 6*c*, and 6*d* all illustrate, diagrammatically, successive positions of components of the handheld twisting tool of the present invention.
Figure 6B:
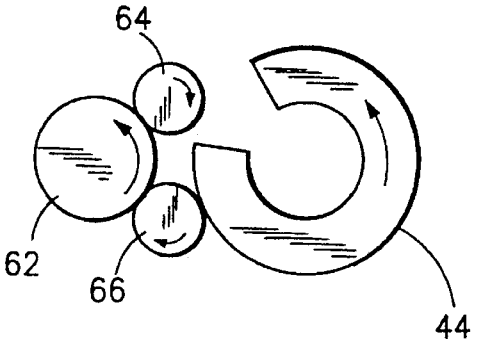
Figure 6C:
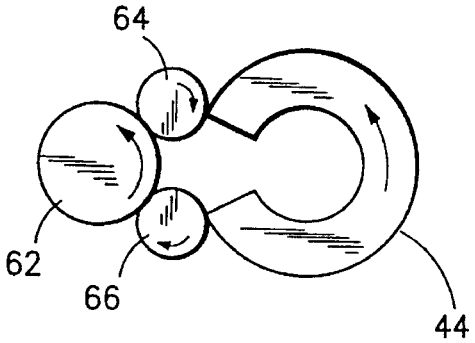
Figure 6D:
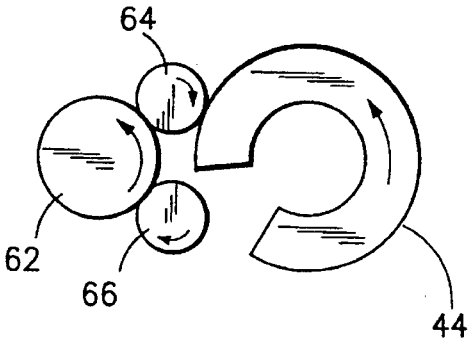

The operative engagement of the pinion gears 64, 66 with the drive gear teeth 72 is at locations which are dimensionally no greater than the width of the inlet 34 in the housing 22. In this manner, at least one of the pinion gears 64, 66 is in engagement with the peripheral gear teeth 72 at all times. This construction is best seen in FIGS. 6*a* through 6*d*. In FIG. 6*a*, both of the pinion gears 64, 66 are operatively engaged with the gear teeth of the drive wheel 44 and the peripheral gap 46 will enable ingress and egress of the electrical harness 110 relative to the transverse passageway 40. However, with continued rotation of the drive wheel 44 about its longitudinal axis, the gear teeth 72 move out of engagement with pinion gear 64 (FIG. 6*b*) such that only pinion gear 62 is effective to impart rotation to the drive wheel. As this occurs, the peripheral gap becomes ever smaller, then nonexistent. Then, with continued rotation of the drive wheel 44 (FIG. 6*c*), the gear teeth 46 advance into engagement with pinion gear 64 and temporarily out of engagement with pinion gear 66 (FIG. 6*d*). Finally, the gear teeth 46 advance to the point at which they are again in operative engagement with both pinion gears 64, 66. With this construction, the wire twisting tool of the invention is able to receive the electrical harness 110 into the transverse passageway 46 at any location along its length, yet the drive wheel 44 is free to rotate about its axis whenever such motion is desired.

Mutually engageable key devices are provided on the socket member 48 and on the drive wheel 44 for releasably attaching the socket member to the drive wheel. In this regard, the drive wheel 44 has an arcuate terminal edge 74 and a key slot 76 in the terminal edge diametrically opposite the peripheral gap 46. Diametrically opposite the peripheral opening 50 in the socket member 48 is a first key member 78 slidably engageable with the peripheral gap 46 in the drive wheel. For its part, the wire engagement member 52 extends to a terminal end 80 including a second key member 82 projecting from the terminal end and slidably engageable with the key slot 76 in the drive wheel.

In operation, a user holding the wire twisting tool 20 (see FIG. 5) attaches a suitable socket wrench 84 to the drive shaft 60 of the gear train 54. With a switch 58 of the ratchet mechanism 56 suitably positioned, the socket wrench 84 is operated until a peripheral gap 46 of the drive wheel 44 is aligned with the inlet 34 of the housing 22. Thereupon, the user advances the tool 20 toward the electrical harness 110 and causes the electrical harness to enter the transverse passageway 40 of the drive wheel 44. Thereupon, the socket member 48 is applied to the electrical harness 110 initially at a spaced distance from the drive wheel. The wire engagement member 52 is inserted between the individual strands 112 such that approximately half of the strands of the harness 110 lie to one side of the member 52 and the other half lie to the other side of the member 52. Thereupon, the socket member 48 is slid lengthwise of the electrical harness 110 such that the key member 78 is received into the peripheral gap 46 and the key member 82 is received in the key slot 76. Thereupon, the user again operates the socket wrench 84 to rotate the wire twisting head 38 until the proper amount of twist is imparted to the harness. At this point, the harness is suitably taped or clamped to retain the twist thus applied. The socket member 48 is slid along the twisted electrical harness 110 until the key member 78 disengages from the peripheral gap 46 and until the key member 82 disengages from the key slot 76. With the peripheral gap 46 once again aligned with the inlet 34 of the housing 22, the remainder of the tool 20 is disengaged from the electrical harness 110. The entire operation just described can be performed again and again at longitudinally spaced locations along the length of the electrical harness 110.

While a preferred embodiment of the invention has been disclosed in detail, it should be understood by those skilled in the art that various other modifications may be made to the illustrated embodiments without departing from the scope of the invention as described in the specification and defined in the appended claims.

What is claimed is:

1. Handheld wire twisting apparatus comprising:

a longitudinally extending housing having an internal cylindrical bearing surface means defining a transverse axis and including an inlet into the bearing cavity being a hiatus in said bearing surface; and an elongated handle adapted to be gripped by a user fixed to and extending from said housing;

wire twisting head means journaled on said cylindrical bearing surface means for rotation about the transverse axis and defining a transverse passageway for reception therethrough of a wire bundle to be twisted, said wire twisting head means including a generally c-shaped cylindrical driven member having a peripheral gap for reception therethrough of the wire bundle into the transverse passageway when the peripheral gap is coextensive with the inlet in said housing, said wire twisting head means preventing entry of the wire bundle into the transverse passageway or egress of the wire bundle from the transverse passageway when the peripheral gap is substantially non-coextensive with the inlet in said housing;

a c-shaped cylindrical socket member having a peripheral opening and adapted for releasable attachment to said drive wheel;

a diametrically extending wire engagement member fixed to said socket member and projecting toward the peripheral opening; and drive means for rotating said wire twisting head means about the transverse axis to thereby mutually twist in opposite directions first and second lengths of the wire bundle.

2. Handheld wire twisting apparatus as set forth in claim 1 wherein said housing includes first and second spaced opposed plate members; and wherein said bearing surface means includes a first arcuate bearing surface on said first plate member and a second arcuate bearing surface on said second plate member, said first and second arcuate surfaces being cylindrical and coplanar.

3. Handheld wire twisting apparatus as set forth in claim 2 wherein said drive means includes gear train means rotatably mounted between said first and second plate members for rotating said head means in one direction about the transverse axis and including ratchet means for preventing rotation of said head means in an opposite direction about the transverse axis.

4. Handheld wire twisting apparatus as set forth in claim 2 wherein said drive means includes gear train means rotatably mounted between said first and second plate members for rotating said head means, selectively, in first and second directions about the transverse axis and including ratchet means for selectively preventing rotation of said head means about the transverse axis, in one instance preventing rotation in the first direction and in another instance preventing rotation in the second direction.

5. Handheld wire twisting apparatus as set forth in claim 1 wherein said drive means includes:

a drive shaft mounted on said housing for rotation about a transverse drive axis;

a drive gear fixed on said drive shaft for rotation therewith;

first and second pinion gears mounted on said housing operatively engaged with said drive gear for rotation about spaced parallel axes; and wherein said wire twisting head means includes a c-shaped drive wheel including integral gear teeth around the periphery thereof operatively engaged with said first and second pinion gears at locations which are dimensionally no greater than the width of the peripheral gap in said head means such that at least one of said first and second pinion gears is in engagement with said peripheral gear teeth at all times.

6. Handheld wire twisting apparatus as set forth in claim 1 including:

mutually engageable key means on said socket member and on said drive wheel for releasably attaching said socket member to said drive wheel.

7. Handheld wire twisting apparatus as set forth in claim 1 wherein said wire twisting head means includes a c-shaped cylindrical drive wheel having the peripheral gap therein and an arcuate terminal edge and a key slot in said terminal edge diametrically opposite the peripheral gap; and wherein said c-shaped cylindrical socket member has a peripheral opening and includes, diametrically opposite the peripheral opening, a first key member slidably engageable with the peripheral gap in said drive wheel;

said wire engagement member extending to a terminal end and including a second key member slidably engageable with the key slot in said drive wheel.

* * * * *